US008568091B2

(12) United States Patent
McCaffrey

(10) Patent No.: US 8,568,091 B2
(45) Date of Patent: Oct. 29, 2013

(54) GAS TURBINE ENGINE SYSTEMS AND METHODS INVOLVING BLADE OUTER AIR SEALS

(75) Inventor: Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 1575 days.

(21) Appl. No.: 12/032,789

(22) Filed: Feb. 18, 2008

(65) Prior Publication Data

US 2009/0208322 A1 Aug. 20, 2009

(51) Int. Cl.
*F01D 11/08* (2006.01)

(52) U.S. Cl.
USPC ..... 415/173.3

(58) Field of Classification Search
USPC ..... 215/174.3, 174.4; 415/174.3, 174.4, 415/170.1, 173.1, 173.3, 113; 277/307
See application file for complete search history.

(56) References Cited

U.S. PATENT DOCUMENTS

| | | | | |
|---|---|---|---|---|
| 4,087,199 | A * | 5/1978 | Hemsworth et al. | 415/173.3 |
| 4,477,086 | A | 10/1984 | Feder et al. | |
| 4,596,116 | A | 6/1986 | Mandet et al. | |
| 4,720,969 | A | 1/1988 | Jackman | |
| 4,826,397 | A * | 5/1989 | Shook et al. | 415/116 |
| 5,158,430 | A * | 10/1992 | Dixon et al. | 415/134 |
| 5,249,920 | A | 10/1993 | Shepherd et al. | |
| 5,253,875 | A | 10/1993 | Gentile | |
| 5,423,659 | A * | 6/1995 | Thompson | 415/173.1 |
| 6,045,310 | A | 4/2000 | Miller et al. | |
| 6,113,349 | A * | 9/2000 | Bagepalli et al. | 415/135 |
| 6,142,731 | A | 11/2000 | Dewis et al. | |
| 6,696,144 | B2 | 2/2004 | Holowczak et al. | |
| 7,153,054 | B2 | 12/2006 | Arbona | |
| 7,726,660 | B2 * | 6/2010 | Datta | 277/411 |
| 8,079,807 | B2 | 12/2011 | Shapiro et al. | |
| 2003/0202876 | A1 | 10/2003 | Jasklowski et al. | |
| 2004/0047726 | A1 * | 3/2004 | Morrison | 415/116 |
| 2005/0179215 | A1 | 8/2005 | Kono | |
| 2005/0220610 | A1 * | 10/2005 | Ghasripoor et al. | 415/173.3 |
| 2006/0082074 | A1 | 4/2006 | Synnott et al. | |
| 2007/0041835 | A1 * | 2/2007 | Charbonneau et al. | 416/97 R |
| 2007/0077141 | A1 * | 4/2007 | Keller | 415/136 |
| 2007/0258809 | A1 * | 11/2007 | Mazzola et al. | 415/173.1 |
| 2008/0025838 | A1 * | 1/2008 | Marini et al. | 415/173.4 |

FOREIGN PATENT DOCUMENTS

| | | |
|---|---|---|
| FR | 2580033 | 4/1985 |

OTHER PUBLICATIONS

EP Search Report dated Sep. 7, 2012.

* cited by examiner

*Primary Examiner* — Nathaniel Wiehe
*Assistant Examiner* — Joshua R Beebe
(74) *Attorney, Agent, or Firm* — Carlson, Gaskey & Olds, PC

(57) ABSTRACT

Gas turbine engine systems and methods involving full ring outer air seals are provided. In this regard, a representative blade outer air seal assembly for a gas turbine engine includes a continuous, annular seal body formed of ceramic matrix composite (CMC) material.

7 Claims, 4 Drawing Sheets

GAS TURBINE ENGINE SYSTEMS AND METHODS INVOLVING BLADE OUTER AIR SEALS

BACKGROUND

1. Technical Field

The disclosure generally relates to gas turbine engines.

2. Description of the Related Art

A typical gas turbine engine incorporates a compressor section and a turbine section, each of which includes rotatable blades and stationary vanes. Within a surrounding engine casing, the radial outermost tips of the blades are positioned in close proximity to outer air seals. Outer air seals are parts of shroud assemblies mounted within the engine casing. Each outer air seal typically incorporates multiple segments that are annularly arranged within the engine casing, with the inner diameter surfaces of the segments being located closest to the blade tips.

SUMMARY

Gas turbine engine systems and methods involving blade outer air seals are provided. In this regard, an exemplary embodiment of a blade outer air seal assembly for a gas turbine engine comprises: a continuous, annular seal body formed of ceramic matrix composite (CMC) material.

An exemplary embodiment of a gas turbine engine comprises: a compressor; a combustion section; a turbine operative to drive the compressor responsive to energy imparted thereto by the combustion section, the turbine having a rotatable set of blades; and a blade outer air seal assembly positioned radially outboard of the blades, the assembly having a continuous, annular seal body formed of ceramic matrix composite (CMC) material.

An exemplary embodiment of a method for providing a blade outer air seal for a gas turbine engine comprises: providing a rotatable set of turbine blades, the turbine blades having blade tips at outboard ends thereof; and positioning an annular seal body formed of ceramic matrix composite (CMC) material about the blades such that the blade tips are located adjacent to an inner diameter surface of the seal body.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems and methods involving full ring outer air seals are provided, several exemplary embodiments of which will be described in detail. In some embodiments, a full (non-segmented) ring outer air seal is formed of a ceramic matrix composite (CMC) material. Based primarily on the thermal properties of the CMC material, in some embodiments, such a full ring outer air seal does not require dedicated supplies of cooling air for cooling the seal.

Figure 1:
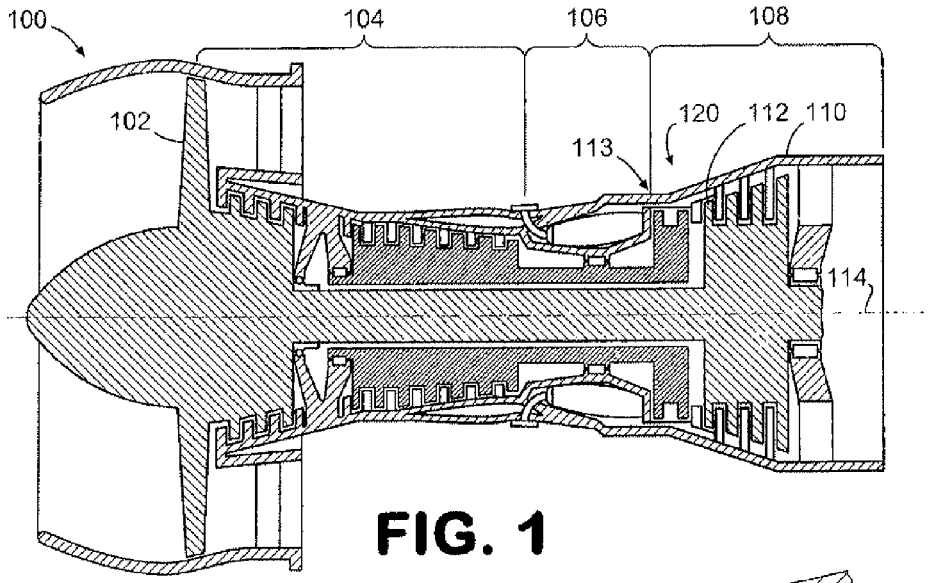
FIG. 1 is a schematic diagram depicting an exemplary embodiment of a gas turbine engine.

In this regard, FIG. 1 is a schematic diagram depicting an exemplary embodiment of a gas turbine engine. As shown in FIG. 1, engine 100 incorporates a fan 102, a compressor section 104, a combustion section 106 and a turbine section 108. Various components of the engine are housed within an engine casing 110, such as a blade 112 of the high-pressure turbine 113. Many of the various components extend along a longitudinal axis 114 of the engine. Although engine 100 is configured as a turbofan engine, there is no intention to limit the concepts described herein to use with turbofan engines as various other configurations of gas turbine engines can be used.

Figure 2:
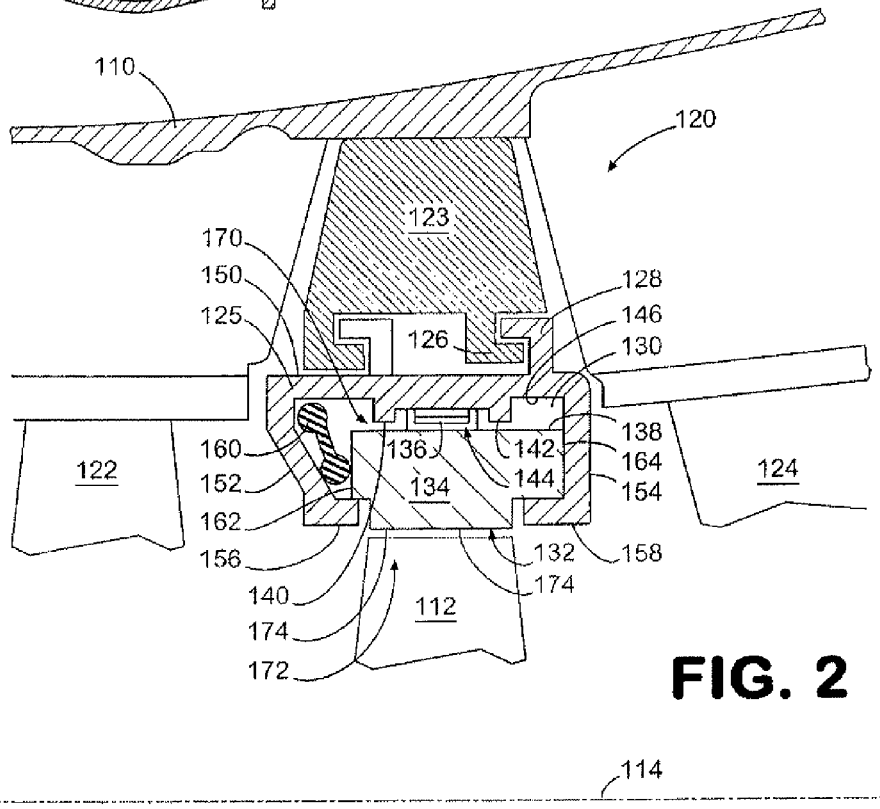
FIG. 2 is a partially cut-away, schematic diagram depicting a portion of the embodiment of FIG. 1.

A portion of engine 100 is depicted in greater detail in the schematic diagram of FIG. 2. In particular, FIG. 2 depicts a portion of blade 112 and a corresponding portion of a shroud assembly 120 that are located within engine casing 110. Notably, blade 112 is positioned between vanes 122 and 124, detail of which have been omitted from FIG. 2 for ease of illustration and description.

As shown in FIG. 2, shroud assembly 120 is positioned between the rotating blades and the engine casing 110. The shroud assembly generally includes an annular mounting ring 123 and a carrier 125, which is attached to the mounting ring and positioned adjacent to the tips of the blades. Attachment of carrier 125 to mounting ring 123 is facilitated by interlocking flanges in this embodiment. Specifically, the mounting ring includes flanges (e.g., flange 126) that engage corresponding flanges (e.g., flange 128) of the carrier. Other attachment techniques may be used in other embodiments. Additionally, various other seals are provided both forward and aft of the shroud assembly; however, these various seals are not relevant to this discussion.

Carrier 125 defines an annular cavity 130, which is used to house a blade outer air seal assembly 132. Assembly 132 includes a seal body 134 and a biasing mechanism 136, each of which is generally annular in shape. In the embodiment of FIG. 2, seal body 134 is continuous (i.e., a full ring) and is formed of CMC material. Biasing mechanism 136 (e.g., a spring assembly) is positioned about the outer diameter surface 138 of the seal body. Biasing mechanism 136 is maintained axially within cavity 130 by protrusions 140, 142 that define a channel 144 oriented along an inner diameter surface 146 of the carrier and within which the biasing mechanism is located.

Use of a separate seal body 134 and carrier 125 enables the seal body to be thermally decoupled from the static structure of the engine. Use of biasing mechanism 136 urges the seal body 134 into axial alignment with the longitudinal axis 114 of the engine, thereby tending to accommodate differences in thermal expansion exhibited by the seal body and mounting ring.

In the embodiment of FIG. 2, carrier 125 includes an outer diameter wall 150 that functions as a mounting surface for flanges, which attach the carrier to mounting ring 123. Extending generally radially inwardly from the ends of the outer diameter wall are a forward wall 152 and an aft wall 154, respectively. The forward wall terminates in a forward lip 156, which is generally annular in shape, and the aft wall terminates in an aft lip 158, which also is generally annular in shape. The forward and aft lips function as retention features that retain the seal body 134 within the annular cavity 130 defined by the carrier 125.

As mentioned previously, radial positioning of the seal body 134 within the cavity 130 is provided, at least in part, by the biasing force provided by the biasing mechanism 136. In contrast, axial positioning of the seal body of the embodiment of FIG. 2 is facilitated by a dog-bone 160, which is generally positioned between the forward wall 152 of the carrier and the forward side 162 of the seal body. In operation, the dog-bone 160 tends to urge the seal body axially toward an aft position, in which an aft side 164 of the seal body can contact the aft wall 154 of the carrier.

It should be noted that in the embodiment of FIG. 2, seal body 134 incorporates an outer diameter portion 170 and an inner diameter portion 172. In this embodiment, the outer diameter portion 170 is wider in an axial direction than is the inner diameter portion 172. As such, the inner diameter portion can extend radially inwardly between the opposing forward and aft lips 156, 158 of the carrier. In this regard, the inner diameter surface 174 of the inner diameter portion 172 is positioned adjacent to the tips of the blades (e.g., blade 112). In some embodiments, one or more surfaces of the seal body (e.g., the inner diameter surface 174) can be coated with one or more coatings in order to promote high temperature durability and/or flow wear resistance, for example.

In some embodiments, the use of CMC materials for forming a seal body can enable a blade outer air seal assembly to run un-cooled. That is, in some embodiments, such a seal body need not be provided with dedicated cooling air for cooling the seal body. However, in some embodiments, components located in a vicinity of the seal body can be cooled, such as the carrier and/or rotating blades.

Figure 3:
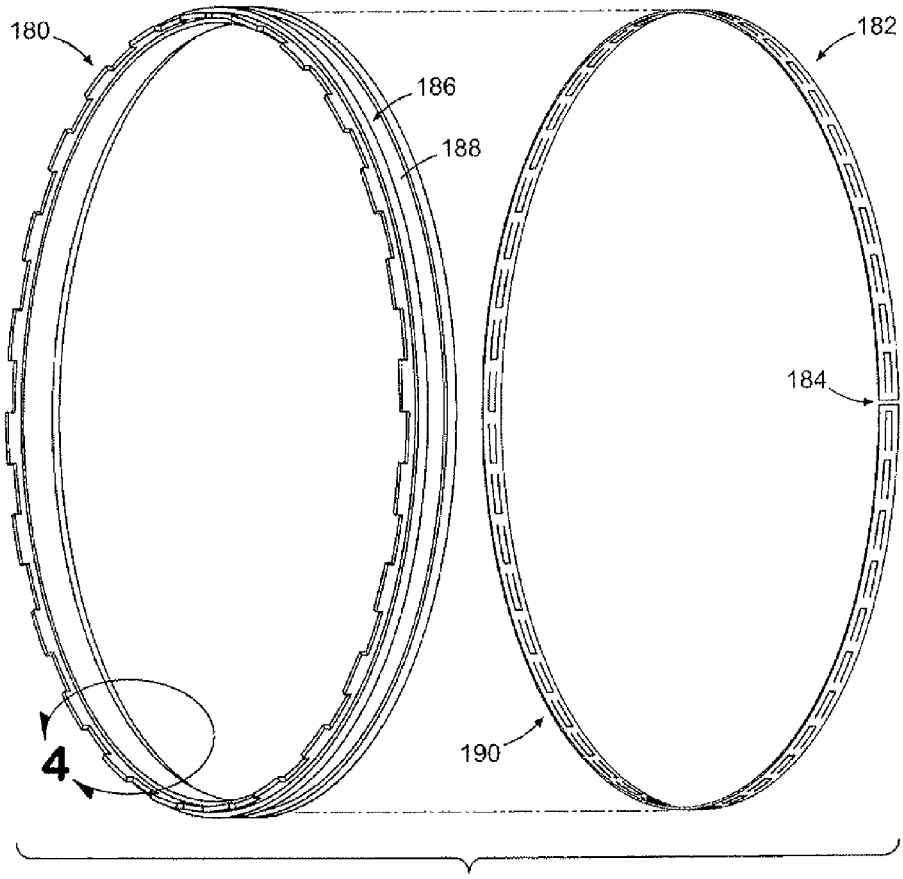
FIG. 3 is a schematic diagram depicting another exemplary embodiment of a seal body and associated biasing mechanism.
Figure 4:
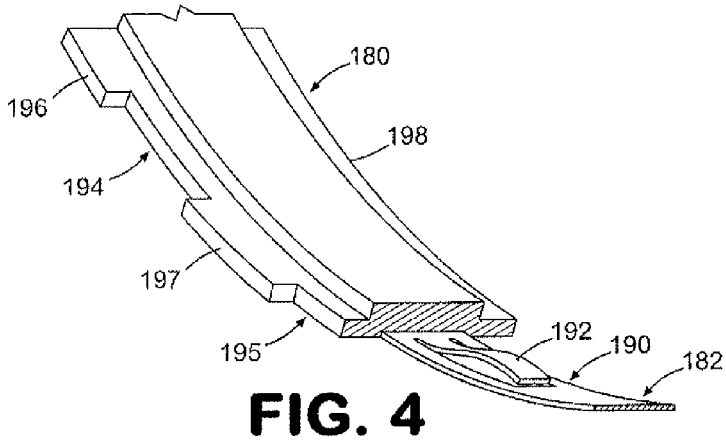
FIG. 4 is a partially cut-away, schematic diagram depicting a portion of the seal body and biasing mechanism of FIG. 3.

FIGS. 3 and 4 schematically depict another embodiment of a seal body and associated biasing mechanism. As shown in FIG. 3, both seal body 180 and biasing mechanism 182 are generally annular in shape. In contrast to the full-ring configuration of seal body 180, biasing mechanism 182 of this embodiment incorporates an area of discontinuity 184 (e.g., a slit) that permits installation and/or removal of the biasing mechanism from an engine. Notably, the biasing mechanism is generally configured as a band that is positioned within an annular channel 186 located in an outer diameter surface 188 of the seal body.

As best shown in FIG. 4, biasing mechanism 182 incorporates biasing members (e.g., member 190) located at various circumferential locations about the biasing mechanism. In this embodiment, each biasing member is configured as a cutout that extends radially inwardly to provide a contact location (e.g., contact location 192) with the outer diameter surface 188 of the seal body. As such, each of the biasing members functions as a spring for imparting a biasing force to the seal body.

Note also that in the embodiment of FIG. 4, seal body 180 incorporates anti-rotation features that tend to prevent clocking of the seal body. In this embodiment, alternating slots (e.g., slots 194, 195) and tabs (e.g., tabs 196, 197) perform the anti-rotation function. In other embodiments, various other features can be used which can additionally or alternatively be located on one or more other surfaces of the seal body, such as the aft side 198. The embodiment of FIG. 4, the slots mate with corresponding tabs provided by a static feature of the engine, such as a vane or strut.

Figure 5:
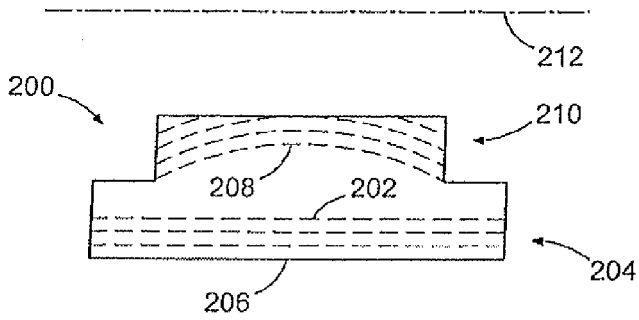
FIG. 5 is a cross-sectional, schematic diagram depicting an exemplary embodiment of a seal body.

As shown in FIG. 5, CMC material forming a seal body can include fibers (depicted by dashed lines) that exhibit selected orientations. In the embodiment of FIG. 5, different portions of the seal body 200 exhibit different fiber orientations. In this embodiment, the fibers (e.g., fiber 202) of the outer diameter portion 204 of the seal body are orientated generally parallel with the outer diameter surface 206. In contrast, the fibers (e.g., fiber 208) of the inner diameter portion 210 of the seal body are generally concave with respect to a longitudinal axis 212 of the seal body. In other embodiments, various other configurations and numbers of fiber orientations may be provided.

Figure 6:
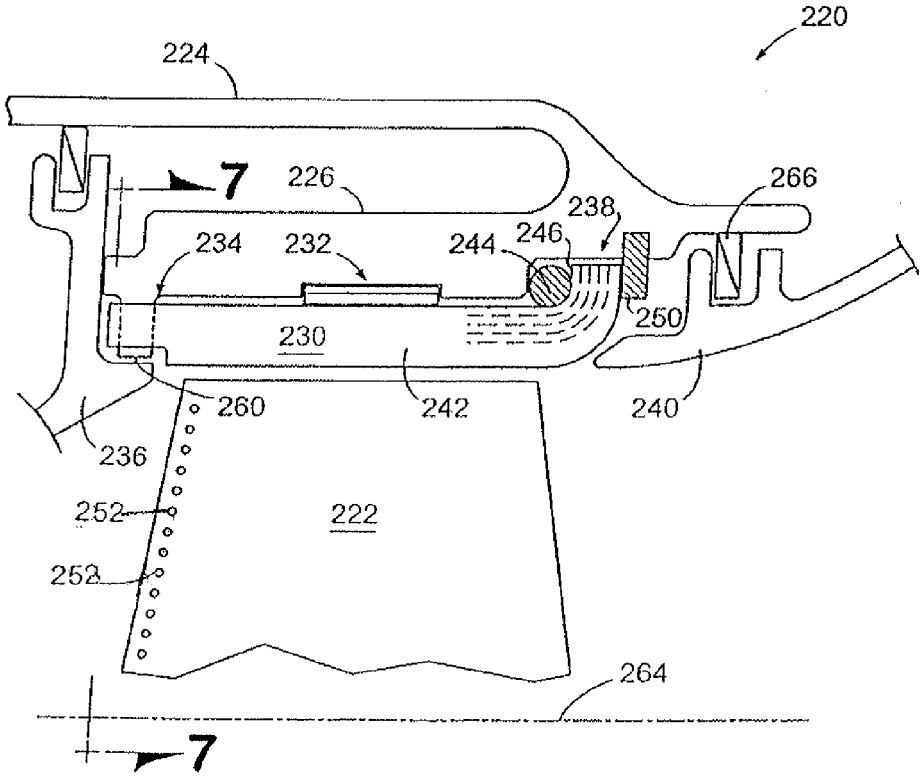
FIG. 6 is a partially cut-away, schematic diagram depicting a portion of another exemplary embodiment of a gas turbine engine.

Another embodiment of a shroud assembly is depicted schematically in FIG. 6. As shown in FIG. 6, shroud assembly 220 is positioned between the rotating blades (e.g., blade 222) and a static portion of engine casing 224. In particular, the shroud assembly generally includes an annular mounting ring 226, a seal body 230 that is positioned adjacent to the tips of the rotating blades, and a biasing mechanism 232.

In this embodiment, the static portions of the engine tend to retain positioning of the seal body 230 without the use of a dedicated carrier. In this regard, the forward end 234 of the seal body is generally retained by a portion of a vane 236, and the aft end 238 of the seal body is generally maintained in position by vane 240. Notably, the aft end of the seal body exhibits a radius of curvature such that the aft end extends radially outwardly from an intermediate portion 242 of the seal body. Such a configuration accommodates the use of a relatively robust aft seal 244, such as a rope seal, that can be positioned between the surface 246 forming the inner curvature radius and the mounting ring. In the embodiment of FIG. 6, a snap ring seal 250 also is provided to assist in sealing and retaining the seal body.

Notably, the CMC material forming seal body 230 includes fibers (depicted by dashed lines) that tend to curve along with the curvature of the seal body. It should also be noted that blade 222 incorporates cooling provisions (e.g., cooling air holes 252), whereas the seal body does not include dedicate provisions for cooling air.

Figure 7:
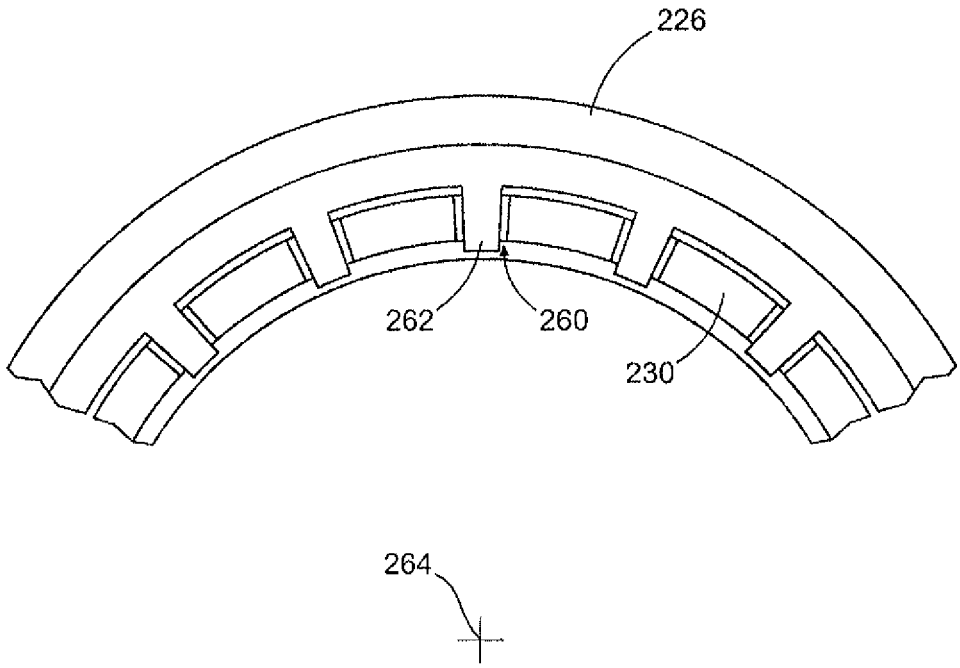
FIG. 7 is a partially cut-away, cross-sectional, schematic diagram as viewed along section line 7-7 of FIG. 6.

Anti-rotation provisioning also is included as shown in FIG. 7. Specifically, seal body 230 incorporates a spaced series of slots (e.g., slot 260) and mounting ring 226 incorporates a corresponding set of tabs (e.g., tab 262). Interference between the tabs and the slots prevents rotation of the seal body about longitudinal axis 264, while clearance between the tabs and the slots prevents binding of during differential thermal expansion/contraction. Notably, biasing mechanism 232 (FIG. 6) is used to reduce the effect of the clearances and urges the seal body to a concentric position about axis 264.

That is, without the biasing mechanism 232, the seal body 230 would be able to move off center, as much as the manufacturing tolerances (clearance) between the slots and the tabs would allow. Thus, during operation the gap between the tip of blade 222 and the seal body 230 can close down more than desired locally and cause rub interactions. The resultant loss of material on either the blade tip or the seal body will increase the actual average gap resulting in a loss of performance.

The circumferential length of the slots and the tab to tab distance (pitch) is designed with the mechanical properties of the CMC in mind. The tabs typically would have a very small circumferential width relative to the circumferential pitch between them. The width-to-pitch ratio is a function of the mechanical properties of the CMC divided by the mechanical properties of the support structure. By way of example, a representative width-to-pitch ratio could typically be between 4:1 and 8:1.

It should also be noted that various types, configurations and numbers of auxiliary seals can be used to form one or more seals with a seal body. By way of example, the embodiment of FIG. 6 uses a rope seal 244, a snap ring 250 and a piston ring 266. Various other seal types, such as U-seals, V-seals and W-seals, for example also can be used. Selection of such seals can be based on a variety of factors, which may include but are not limited to operating temperature, cooling provisions, surface preparation requirements, conformability to adjacent surfaces, pressure ratio across the seal, and relative movement of the seal and/or retention features.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A blade outer air seal assembly for a gas turbine engine having a longitudinal axis comprising:

a continuous, annular seal body formed of ceramic matrix composite (CMC) material wherein:

the seal body has an outer diameter surface;

the assembly further comprises a spring assembly operative to engage the outer diameter surface of the seal body at multiple circumferential locations about the seal body such that the seal body is urged into alignment about the longitudinal axis of the gas turbine engine;

a carrier holding said seal body in alignment with a blade, said carrier having a forward lip und an aft lip that retain said seal body, an aft wall in which said aft lip terminates, said aft wall engaging said seal body; and a dog bone urging said seal body axially against said aft wall.

2. The assembly of claim 1, wherein:

the seal body has a recess formed along the outer diameter surface; and the spring assembly seats at least partially within the recess.

3. The assembly of claim 1, wherein:

the CMC material forming the seal body comprises fibers; and the fibers associated with an inner diameter portion of the seal body are concave with respect to a longitudinal axis of the seal body.

4. The assembly of claim 1, wherein:

the CMC material forming the seal body comprises fibers; and the fibers associated with an inner diameter portion of the seal body are aligned differently than the fibers associated with an outer diameter portion of the seal body.

5. The assembly of claim 1, wherein:

the seal body has an upstream end and a downstream end; and at least one of the upstream end and the downstream end exhibits a radial curvature.

6. The assembly of claim 5, wherein:

the CMC material forming the seal body comprises fibers; and the fibers associated with the radial curvature are aligned to curve with the radial curvature.

7. The assembly of claim 5, wherein the end exhibiting the radial curvature extends radially outwardly from an adjacent, intermediate portion of the seal body.

* * * * *